US005520437A

United States Patent [19]

LaPointe et al.

[11] Patent Number: 5,520,437

[45] Date of Patent: May 28, 1996

[54] MOUNTING APPARATUS FOR A MODULAR SOFA ASSEMBLY

[75] Inventors: Larry P. LaPointe, Temperance; Jonathan R. Saul, LaSalle; Karl J. Komorowski, Petersburg, all of Mich.

[73] Assignee: La-Z-Boy Chair Company, Monroe, Mich.

[21] Appl. No.: 109,832

[22] Filed: Aug. 20, 1993

[51] Int. Cl.[6] ..... A47C 15/00

[52] U.S. Cl. ..... 297/233; 297/248; 297/463.1

[58] Field of Search ..... 297/233, 232, 297/248, 257, 311, 344.1, 440.1, 440.14, 463.1; 403/205; 248/501

[56] References Cited

U.S. PATENT DOCUMENTS

| | | | |
|---|---|---|---|
| 53,415 | 3/1866 | Cole | 248/501 |
| 1,335,842 | 4/1920 | Lambert . | |
| 2,153,679 | 4/1939 | Rich | 248/501 X |
| 3,162,484 | 12/1964 | Kleffman | 297/248 |
| 3,640,569 | 2/1972 | Young . | |
| 3,841,701 | 10/1974 | Sullivan . | |
| 4,043,591 | 8/1977 | Lehmann . | |
| 4,077,666 | 3/1978 | Heumann | 297/248 X |
| 4,114,947 | 9/1978 | Nelson . | |
| 4,311,337 | 1/1982 | Brunn . | |
| 4,395,071 | 7/1983 | Laird . | |
| 4,595,164 | 6/1986 | Froutzis et al. . | |
| 4,740,031 | 4/1988 | Rogers, Jr. . | |
| 4,848,839 | 7/1989 | Galardo . | |
| 4,848,843 | 7/1989 | Gibbs . | |
| 5,234,253 | 8/1993 | LaPointe et al. | 297/248 |
| 5,352,017 | 10/1994 | Berning | 297/248 |

FOREIGN PATENT DOCUMENTS

| | | | |
|---|---|---|---|
| 2817792 | 10/1979 | Germany | 297/248 |
| 667245 | 2/1952 | United Kingdom . | |
| 724365 | 2/1955 | United Kingdom . | |
| 827904 | 2/1960 | United Kingdom . | |
| 831582 | 3/1960 | United Kingdom . | |

*Primary Examiner*—Milton Nelson, Jr.
*Attorney, Agent, or Firm*—Harness, Dickey & Pierce

[57] ABSTRACT

A mounting apparatus for securing a plurality of independent seating sections together to form a modular sofa assembly. The independent seating sections have lower front and rear end portions with either front and rear cross bars substantially parallel to the front and rear end portions or side frame members substantially perpendicular to the front and rear end portions. A first elongated frame rail is secured to the front and rear of each seating unit having side frame members, and connecting feet are secured to seating units having front and rear cross bars. The seating units are aligned in close side-by-side proximity and connecting links are used to secure the frame members or connecting feet of adjacent seating units to form a sofa or loveseat. The sofa or loveseat is easily disassembled by removing the connecting links from the frame members and connecting feet. Elongated apertures in the frame members and connecting feet engage locking tabs formed in the connecting feet to secure the connecting links to the frame members and connecting feet and to provide adjustment of the side-by-side relationship of the seating units.

22 Claims, 6 Drawing Sheets

FIG 1
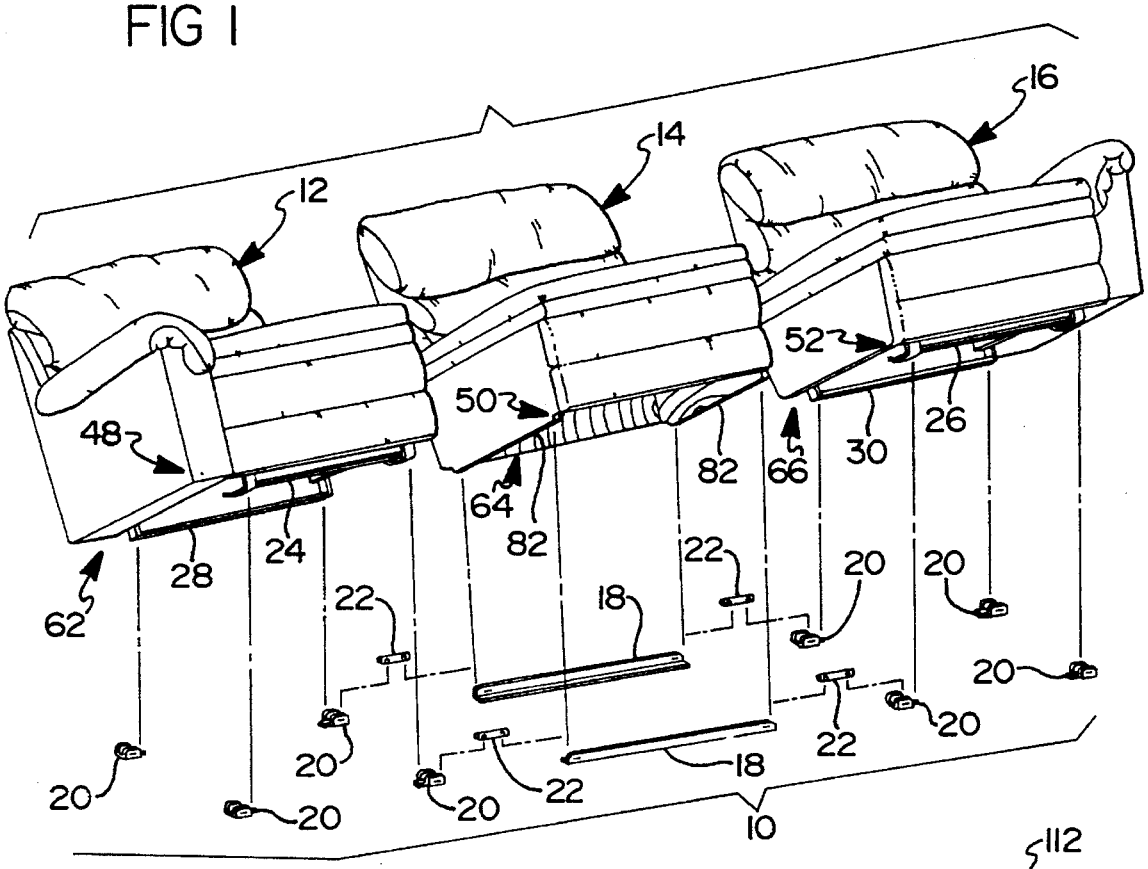
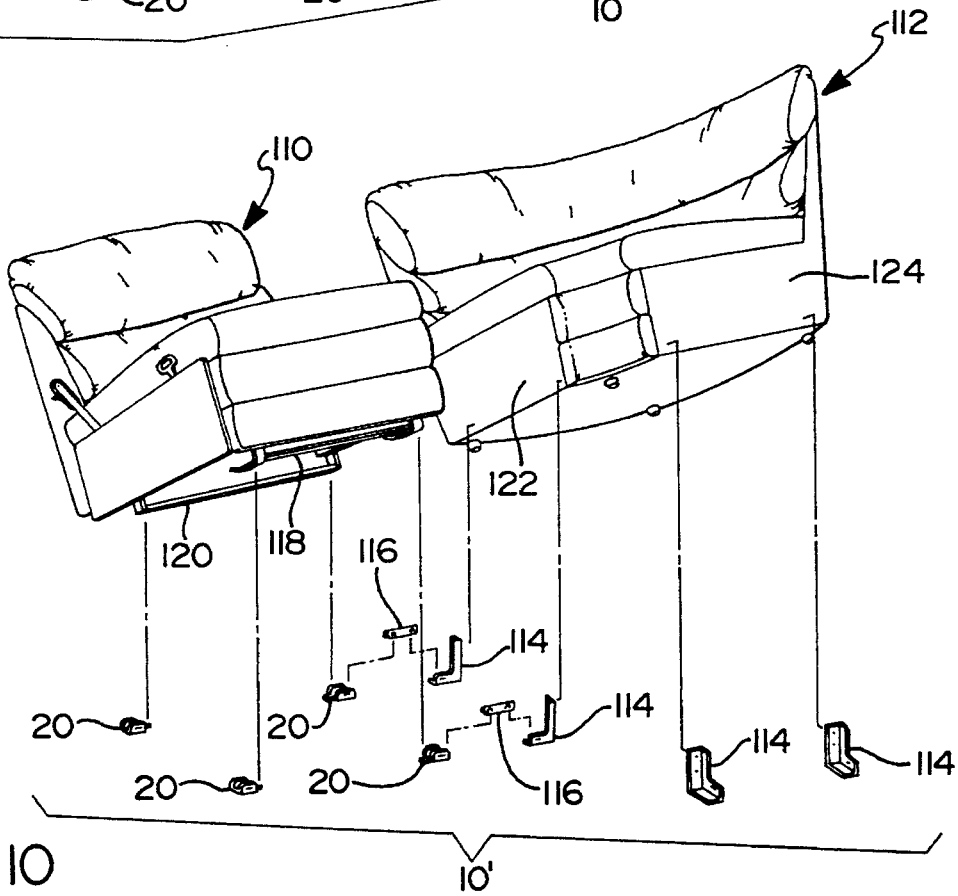
FIG 10

3
3

18
20
22
24
28
32
34
36
38
40
42
44
46
54
56
58
60
68
70
72
74
78
80
92
94
96

FIG 11
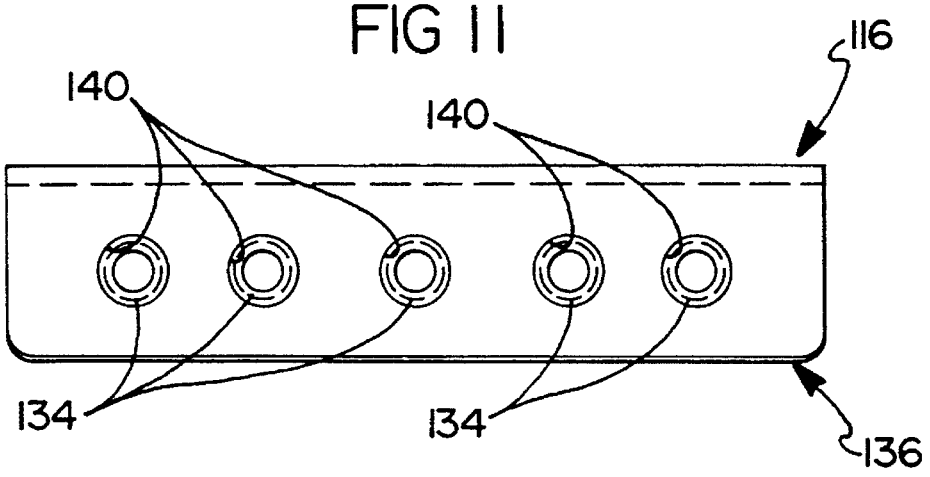
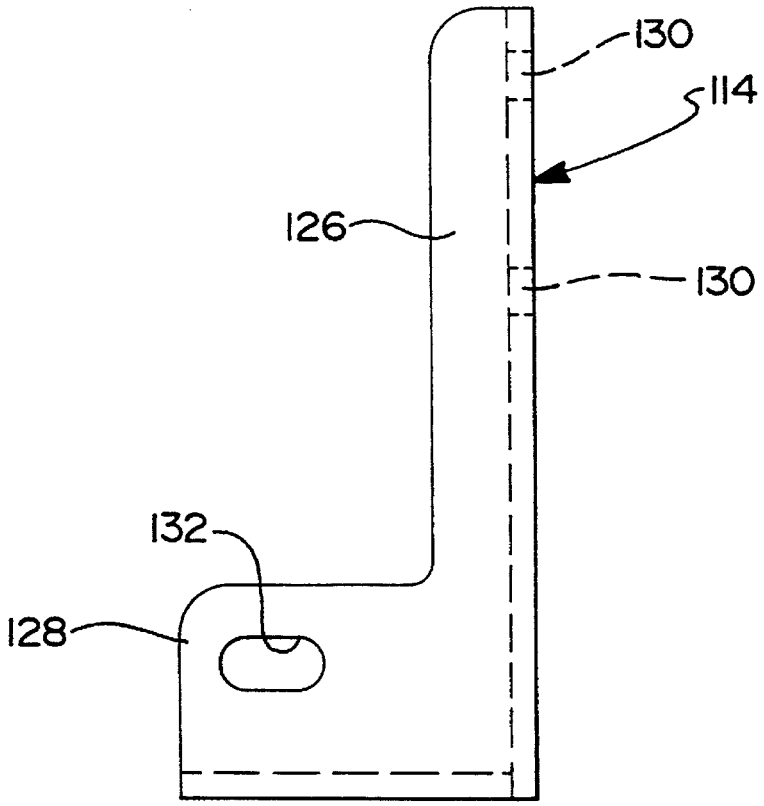
FIG 12

14
14
100
44
18
92
132
114
116
134
20
24
26
46
60
136
138
140

MOUNTING APPARATUS FOR A MODULAR SOFA ASSEMBLY

BACKGROUND OF THE INVENTION

1. Technical Field

The present invention relates to furniture and, more particularly, to a mounting apparatus for removably securing a plurality of independent seating sections together in a side-by-side configuration in modular fashion to form a loveseat, sofa or the like.

2. Discussion

Present day sofas now often incorporate one or more seating sections which function as recliners to provide a significant degree of added comfort when compared with many conventional sofas incorporating a single fixed seating arrangement. Such sofa assemblies incorporating one or more recliner seating sections enable the owner to "customize" a sofa assembly to fit her/his specific needs and lifestyle.

With sofa assemblies as described above, it has heretofore been necessary to secure the recliner section(s) of the sofa together with the remaining seating section(s) via use of a permanent frame, usually constructed integrally with the various seating sections at the factory. Accordingly, when the sofa assembly is shipped it must be shipped as one single, relatively large structure.

While the permanent frame has proved to provide good structural strength to the sofa assembly, it would be desirable to provide removable frame-like apparatus to secure the various sections of a modular sofa assembly together after the assembly has reached its destination. This would significantly ease the shipping and handling of such sofa assemblies as the various components thereof could be shipped and handled independently. At the destination, the ability to individually handle the components of the sofa assembly would contribute to much easier handling of the sofa assembly when transporting it, for example, within hallways and through doorways of rooms in a home, apartment or even an office. By being able to handle individual sections of a sofa assembly independently, the entire sofa assembly is capable of being handled and transported through such areas where the completely assembled sofa assembly might be too large and cumbersome to handle or transport. In addition, it is desirable to include three or more reclinable seating units in a sofa assembly. The added weight of these additional recliner units would make a typical sofa heavy and difficult to handle and transport, whereas the individual seating units are easily handled and transported if detached from the sofa assembly.

It would further be desirable if such a frame-like mounting apparatus as described above incorporated some means for enabling the modular sections of the sofa assembly to be laterally adjusted to compensate for slightly varying thicknesses of fabric and padding. The need for allowing some adjustability in a frame-like mounting apparatus as described above is particularly acute when one or more recliner chair sections are included to form the modular sofa assembly. The recliner sections must be able to recline freely with a minimum amount of friction from adjacent stationary seating sections, and yet the clearance between the recliner sections and other sections of the sofa assembly must not be so great as to allow unnecessary gap clearance between adjacent seating sections of the sofa assembly. Such a mounting apparatus is disclosed in the commonly assigned U.S. Pat. No. 5,234,253, the disclosure of which is hereby expressly incorporated herein by reference.

The advantage of such a frame-like mounting apparatus as described in the above referenced U.S. Patent is the flexibility in changing the configuration of the sofa assembly as the needs of the owner change. For example, if the sofa assembly was originally purchased with three sections, the owner could at a later time eliminate the center section and reinstall the two other sections on shorter frame rails to achieve a loveseat configuration. Accordingly, there would be no need for the owner to order an entire new sofa assembly comprising only two sections if the owner desired to utilize the sofa in a location with space restrictions or for other reasons.

Still additional advantages would be derived from a frame-like mounting apparatus which comprises individual frame members associated with each of the individual sofa assembly sections. These frame members could be easily and rigidly interconnected within the home or office to secure the seating sections together. The interconnecting links and frame members would be small and lightweight such that the average homeowner would easily be able to assemble the sofa or loveseat unit. In addition, the largest frame members would be no longer than an individual sofa section is wide. Therefore, frame members as long as the desired sofa are not required. Also, to convert the unit from a two, three, four or more section unit would not require obtaining additional frame members. Instead the seating units themselves could simply be connected together. The individual frame members as well as the interconnecting links would also provide for the foregoing discussed lateral adjustment.

It is therefore a principal object of the present invention to provide a mounting apparatus for a modular sofa assembly which may be removably secured to the various seating sections of the sofa assembly at the factory or at the destination where the sofa assembly is to be installed.

It is still a further object of the present invention to provide a mounting apparatus which may be secured to various sections of a modular sofa assembly quickly, easily and without any special tools.

It is yet another object of the present invention to provide a mounting apparatus which incorporates means for adjustably positioning adjacent seating sections of a modular sofa assembly to thereby compensate for varying thicknesses in fabric, cushioning, etc. of the various seating sections.

It is still another object of the present invention to provide a mounting apparatus for a modular sofa assembly which enables a particular seating section, for example, a fixed seating section to be detached from the apparatus and substituted with another seating section, for example, a reclining seating section.

It is yet another object of the present invention to provide a mounting apparatus which may be easily and conveniently shipped and handled together with independent seating sections to which the apparatus is ultimately to be secured.

SUMMARY OF THE INVENTION

The above and other objects of the present invention are accomplished by a mounting apparatus in accordance with the preferred embodiments of the present invention. The preferred embodiments of the mounting apparatus comprise a plurality of frame rails, connecting feet, angle brackets and connecting links. The frame rails, connecting feet and angle brackets are preferably removably secured to the individual seating sections at the factory, while the connecting links are removably secured to the frame rails and connecting feet at the installation site such as the dealer or distributor, but preferably at the home or office of the owner of the sofa assembly. Accordingly, various seating sections of the sofa assembly are capable of being quickly and easily assembled at the manufacturer's dealership/distributor, retailers of the manufacturer's furniture or even by the ultimate purchaser. The removable nature of the connecting links enables particular sections of the sofa assembly to be removed and substituted with other suitable seating sections. Accordingly, the owner of the sofa assembly is afforded the ability to "customize" his/her sofa assembly to suit his/her specific needs and lifestyle.

The mounting apparatus of the present invention further greatly eases the shipping and handling of the components which when in assembled form comprise a modular sofa assembly. This added ease and handling in transportation, in some instances, may even enable "oversized" sofa assemblies to be constructed within a particular room of a home of the owner, which oversized sofa assembly would otherwise not be adapted to be handled and moved through hallways and door areas of the home.

DESCRIPTION OF THE DRAWINGS

FIG. 1 is an exploded perspective view of a modular sofa assembly in accordance with a first preferred embodiment of the invention showing how three independent seating sections may be alignably configured together in a side-by-side arrangement and removably secured together via frame rails, connecting feet and connecting links;

FIG. 10 is a view similar to FIG. 1, showing the interconnection of an independent reclinable seating section with a corner seating section in side-by-side arrangement and removably secured together via connecting feet and angle brackets according to a second preferred embodiment of the invention;

FIG. 11 is a front elevational view of a connecting link according to a second preferred embodiment of the invention;

FIG. 12 is a front elevational view of an angle bracket of the invention;

DETAILED DESCRIPTION OF THE INVENTION

Figures 2A, 2B, 2C, 3:
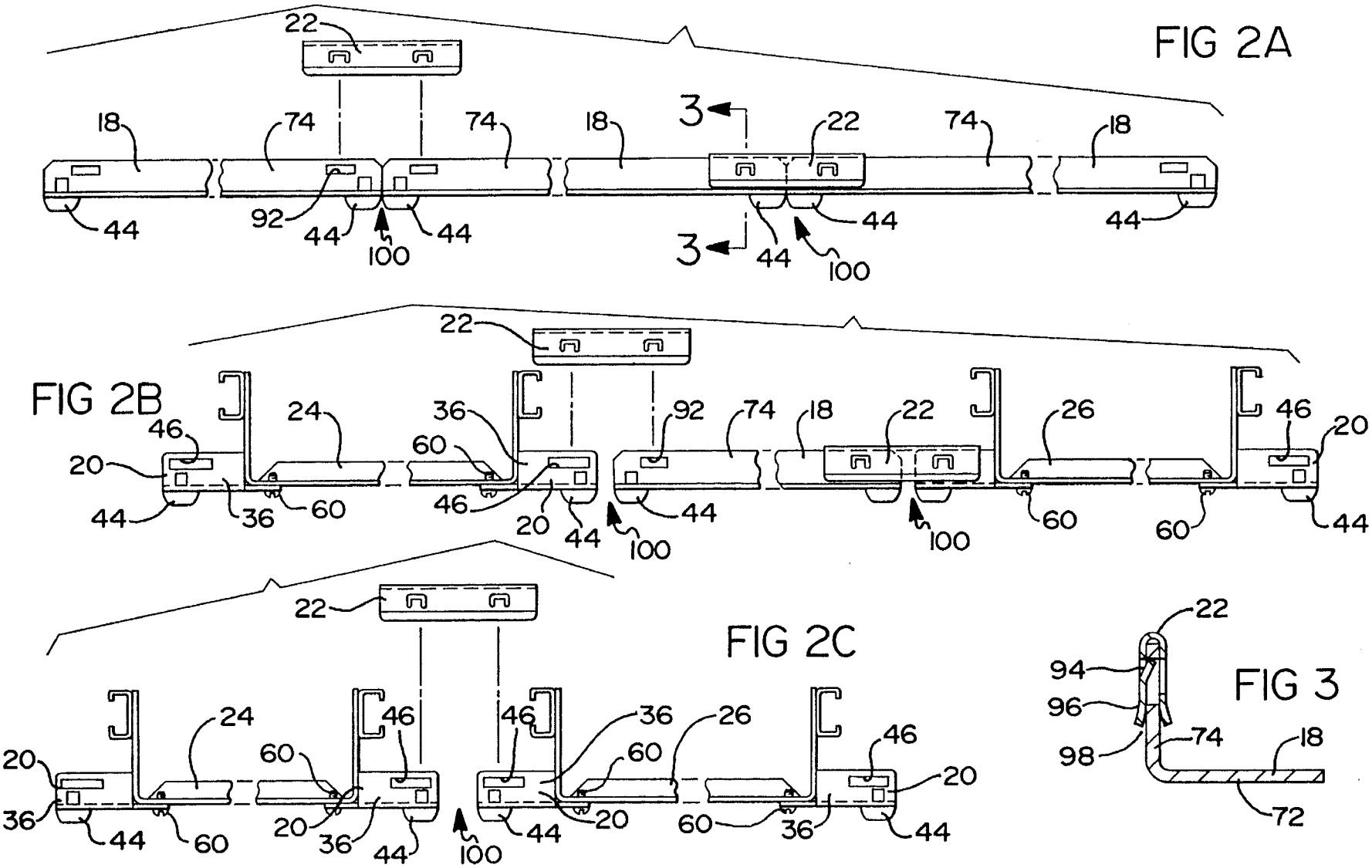
FIGS. 2A–2C are partial schematic front views of exemplary arrangements of frame rails, connecting feet and connecting links according to a first preferred embodiment of the invention.
FIG. 3 is a section view as indicated by line 3—3 in FIG. 2A showing the engagement of the connecting link with a connecting rail.

In accordance with the teachings of the present invention, a mounting apparatus particularly well-suited for removably securing a plurality of recliner sections together to form a modular sofa assembly is disclosed. It should be understood from the outset that the mounting apparatus of the present invention is readily adaptable to any number of types of seating units including those disclosed in the commonly assigned U.S. Pat. Nos. 5,141,284; 5,234,253 and U.S. patent application Ser. No. 08/040 004 filed Apr. 9, 1993 the disclosures of which are hereby expressly incorporated herein by reference.

Referring to FIG. 1, a mounting apparatus 10 in accordance with a first preferred embodiment of the present invention is shown. Also shown are a plurality of independent, modular seating sections 12, 14 and 16, with seating sections 12 and 16 being of the recliner type and having recliner mechanisms like that disclosed in the aforesaid U.S. Pat. No. 5,141,284. The mounting apparatus 10 of the present invention generally comprises a plurality of frame rails 18 and connecting feet 20 secured to seating units 12–16, the frame rails and/or connecting feet which are interconnected by connecting links 22.

Figures 4, 5, 6, 7, 8:
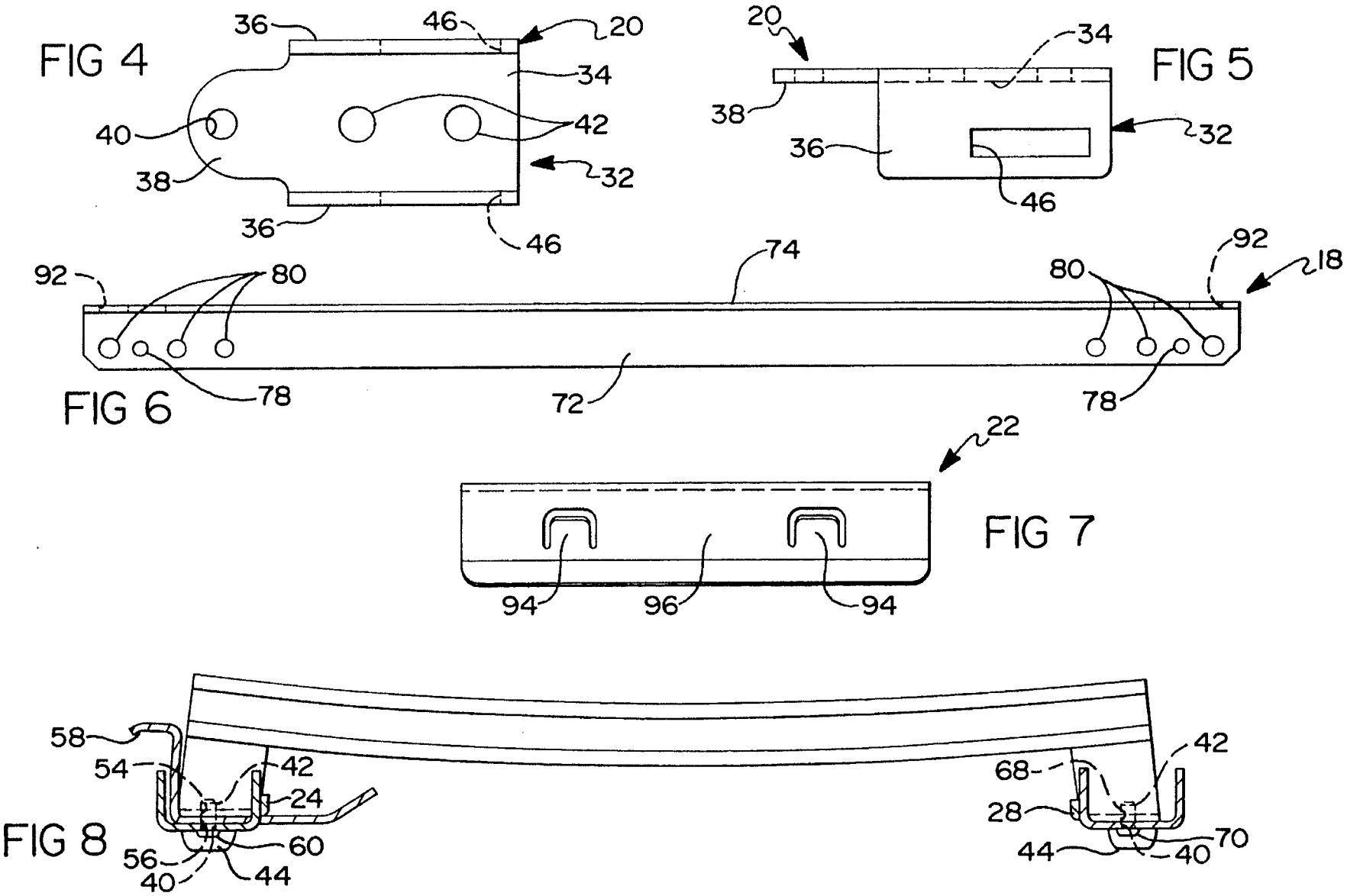
FIG. 4 is a top view of a connecting foot of the invention.
FIG. 5 is a side view of a connecting foot.
FIG. 6 is a top view of frame rail.
FIG. 7 is a front view of a connecting link.
FIG. 8 is a side elevational view showing the assembly of the connecting feet to the channel tracks of a recliner seating section.

With reference to FIGS. 4 and 5, a connecting foot 20 particularly adapted to be secured to seating units having front and rear cross bars such as cross bars 24, 26 and 28, 30 of seating units 12 and 16, respectively, is shown. Connecting foot 20 includes a generally U shaped portion 32 including a base portion 34, extending leg members 36, and an outwardly extending mounting tab 38. Mounting tab 38 is formed with an aperture 40 for detachably mounting connecting foot 20 to a seating unit and threaded apertures 42 formed in base portion 34 are provided for receiving foot member 44, best seen in FIG. 8. Foot members 44 are adjustably received in threaded apertures 42 formed in connecting feet 20 and frame rails 18. In the preferred embodiment, a foot member 44 is provided at each corner of seating units 12–16. As stated, foot members 44 are adjustably received in threaded apertures 42 and thus may be adjusted to prevent bowing of the sofa or loveseat unit under the weight of the occupants. In addition, a slight amount of positive bow may be provided such that the sofa or loveseat unit deflects to a substantially flat position under the weight of occupants.

With reference once again to FIGS. 4 and 5, elongated apertures 46 formed in leg members 36 are provided for releasably engaging connecting links 22 and interconnecting seating units 12–16 as will be explained. As can be seen in FIG. 8, connecting feet 20 are detachably mounted to forward portions 48 and 52 of seating units 12 and 16 via a threaded screw 60 that is passed through the aperture 40 and is threaded into threaded apertures 54, 56 formed in cross-bar 24 and mounting/stop bracket 58, respectively. At the rearward portions 62 and 66 of seating units 12 and 16, connecting feet 20 are detachably mounted to cross-bar 28 via a threaded screw 70 that is passed through the aperture 40 and is threaded into a threaded aperture 68 formed in cross-bar 28. As will be appreciated, connecting feet 20 are attached at each end of the front and rear cross bars in substantially identical manner and therefore four connecting feet 20 are used per seating unit. In addition, it is preferable that connecting feet 20 be attached at the factory thus minimizing the amount of assembly required by the owner.

Figure 9:
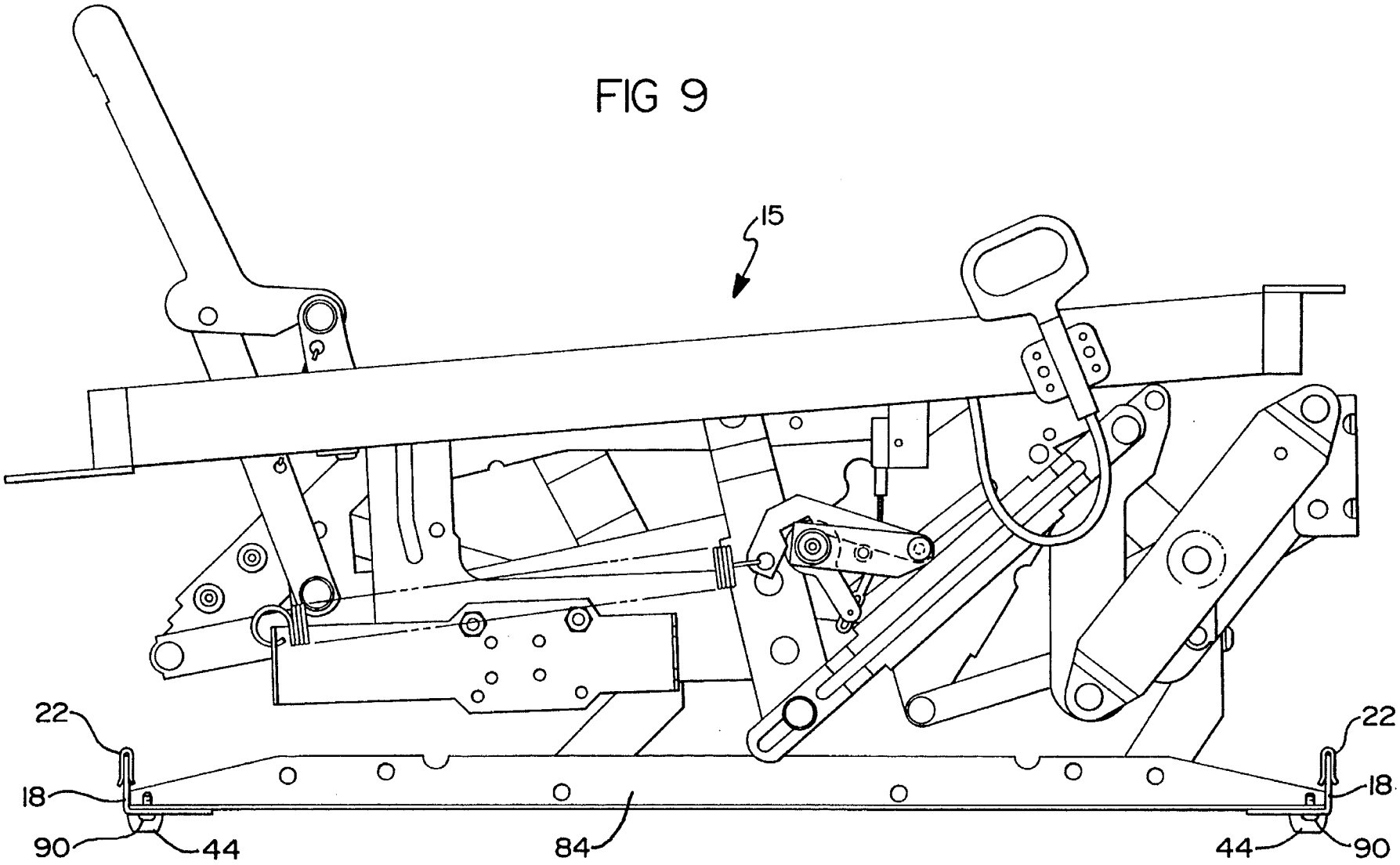
FIG. 9 is a side elevational view of a reclining seating unit mechanism showing the assembly of the frame rails to the recliner mechanism base.

Referring to FIG. 6, frame rail 18 is an elongated L shaped member having a base leg 72, an upstanding leg 74 and a plurality of mounting apertures 78 for detachably mounting frame rail 18 to seating unit 14 and a plurality of threaded apertures 80 for receiving foot members 44 as described and as best seen in FIGS. 2A and 2B. Frame rail 18 in length is approximately the width of a seating unit to which it is mounted and is adapted to span the distance between, for example, side edge portions 82 of fixed seating unit 14 or lower frame portions 84 of reclinable seating unit 15 shown in FIG. 9 and which seating unit is more completely described in the aforementioned U.S. patent application Ser. No. 08/040,004. On a non-reclinable seating unit such as shown in FIG. 1, frame rail 18 may be connected to side portions 82 via frame rail apertures 78 and suitable threaded fastener means such as threaded screws. Similarly, frame rails 18 may be connected to lower frame portions 84 of reclinable seating unit 15 via threaded apertures (not shown) formed in lower frame portion 84, frame rail threaded apertures 78 and threaded screws 90. Frame rail 18 is further provided on each end of upstanding leg 74 with elongated apertures 92 for releasably engaging connecting links 22. It should be understood that frame rails 18 and connecting feet 20 are constructed from steel or other material having relatively good structural strength and rigidity. It should be further understood that frame rails 18 are connected at both the front and rear portions of the seating units which attachment is preferable completed at the factory.

With reference to FIGS. 3 and 7, connecting link 22 is shown having a generally U shaped cross-section and at least two inwardly deflecting locking tabs 94 formed in a side wall portion 96. Preferably, connecting link 22 is formed from resilient spring steel with an opening 98 slightly less than the thickness of connecting feet leg members 36 and frame rail upstanding leg member 74 for providing a snug fitting engagement. Opening 98 is also advantageously flanged slightly more open at its end for facilitating engagement of connecting link 22 with connecting feet 20 and frame rail 18. It should be reiterated that connecting feet 20 and frame rails 18 are preferably assembled to seating units 12–16 at the factory, and then connected via connecting links 22 at the distributor's showroom or, more preferably, at the customer's home or office to link the seating units and form the sofa or loveseat.

With reference then to FIGS. 2A–2C, the manner in which seating units 12–16 are alignably coupled to form a sofa or loveseat is shown. FIG. 2A schematically illustrates the mounting apparatus 10 for interconnecting seating units without front and rear cross bars such as fixed seating unit 14 or reclinable seating unit 15 to form a sofa. As described, frame rails 18 are detachably mounted to, for example, side edge portions 82 of fixed seating unit 14. The seating units are then aligned proximately adjacent each other in side-by-side relationship as shown schematically by the arrangement of frame rails 18. Connecting links 22 are pressed down over frame rail upstanding leg portion 74 of each frame rail 18 associated with the adjacent seating units to be joined. As best seen in FIG. 3, when seated over leg portion 74, connecting link tabs 94 engage elongated apertures 92 of adjacent frame rails 18 secured to adjacent seating units thereby lockingly securing connecting link 22 to frame rails 18. Connecting links 22 are similarly connected to frame rails 18 at each interface 100 of adjacent seating units thereby rigidly linking the seating units together.

As previously indicated, an important object of the present invention is providing adjustability between adjacent seating sections joined to form a sofa or loveseat. The adjustment of the adjacent seating units allows for positioning the seating units closely enough together so as to provide a comfortable, continuous and aesthetically pleasing seating surface while still providing enough clearance for smooth operation of any reclining units incorporated into the sofa. In this regard, frame rail elongated apertures 92 are approximately about ¾" in length while connecting link tabs 94 are approximately about ⅜" in length. As will be appreciated, this arrangement conveniently provides for about ¾" of side to side lateral adjustment between the two adjacent seating units.

FIG. 2B schematically illustrates the mounting apparatus 10 for interconnecting a pair of seating units having front and rear cross bars, such as reclining seating units 12 and 16, to a center seating unit which does not have front and rear cross bars, such as fixed seating unit 14 or reclining seating unit 15. In this arrangement, connecting feet 20 are detachably secured to front and rear cross bars 24, 26 and 28, 30 of seating units 12 and 16, respectively as previously described. Frame rails 18 are detachably secured to the center seating unit and the seating units are arranged as shown schematically in FIG. 2B in proximate side-by-side relationship. Connecting links 22 are pressed down over frame rail upstanding leg 74 and connecting foot leg member 36 with connecting link tabs 94 engaging frame rail elongated aperture and connecting foot elongated aperture 92 and 46, respectively, to rigidly, yet detachably, secure the seating units together to form a sofa.

As discussed, elongated apertures 92 and 46 of frame rails 18 and connecting feet 20, respectively, and connecting link locking tabs 94 provide means for adjusting the side-by-side relationship of adjacent seating units. Connecting foot elongated aperture 46 is approximately about 1⅛" in length. Therefore, the above interconnection provides approximately 1⅛" of side-by-side adjustment between a seating unit adapted with connecting feet 20 and a seating unit adapted with frame rails 18.

Similar to the above arrangements, FIG. 2C illustrates the mounting apparatus 10 for interconnecting a pair of seating units having front and rear cross bars. In this case, connecting feet 20 are detachably secured to the front and rear cross bars, such as front and rear cross bars 24, 26 and 28, 30 of reclinable seating units 12 and 16. As with the other interconnection arrangements, the seating units are aligned in close side-by-side relationship. Connecting links 22 are then pressed over connecting feet leg members 36 at each interface 100 of adjacent seating units with tabs 94 engaging connecting feet elongated apertures 46 to rigidly, yet detachably, interconnect the seating units.

As stated above the connecting links provide a rigid, yet detachable, interconnection of seating units. This important feature of the present invention provides for simply and easily disconnecting the seating units for rearranging, transporting, or storing the sofa or loveseat assembly. Connecting links 22 rigidly secure the seating units together by snuggly fitting over frame rail upstanding leg member 74 and connecting feet leg members 36 and by locking tabs 94 engaging frame rail elongated apertures 92 and connecting feet elongated apertures 46. Connecting links 22 may be removed by simply deflecting locking tab 94 out of engagement with elongated apertures 92, 46 and sliding connecting link 22 off of the frame rail 18 or connecting foot 20, respectively. Locking tab 94 can easily be deflected by inserting a standard head screw driver or other suitable flat object between connecting link 22 and frame rail 18 or connecting foot 20 and thereby deflecting locking tab 94.

Thus, the present invention provides quick and simple means for both assembling and disassembling a sofa or loveseat assembly allowing the owner to create numerous varying configurations of independent seating units.

With reference to FIG. 10, a mounting apparatus 10' is shown interconnecting a reclinable seating unit 110 with a corner seating unit 112 via connecting feet 20, angle brackets 114 and connecting links 116 according to a second preferred embodiment of the invention. Like reference numerals are used to describe like elements from the preceding embodiment. As can be seen in FIG. 10, reclinable seating unit 110 includes front and rear cross-bars 118 and 120, respectively, to which connecting feet 20 are connected as previously described. Angle brackets 114 are suitably secured, such as by threaded fasteners, to side wall portions 122 and 124 of corner seating unit 112.

As can be seen in FIG. 12, angle brackets 114 are a generally L shaped structural member which is formed to a substantially right angle with an upstanding leg portion 126 and laterally extending leg portion 128. Upstanding leg portion 126 is formed with a plurality of apertures 130 for securing angle bracket 114 to seating units which have neither transverse or longitudinal extending frame members. In such cases, angle brackets may be secured to side wall portions, such as side wall portions 122 and 124 of corner seating unit 112, with laterally extending leg portion 128 protruding outwardly therefrom. Leg portion 128 is formed with an elongated aperture 132 for interconnecting angle bracket 114 with connecting feet 20 or frame rails 18 secured to adjacent seating units to be interconnected by connecting links 22 or, as is shown in FIGS. 10 and 13A–13C, with connecting links 116.

Figures 13A, 13B, 13C, 14:
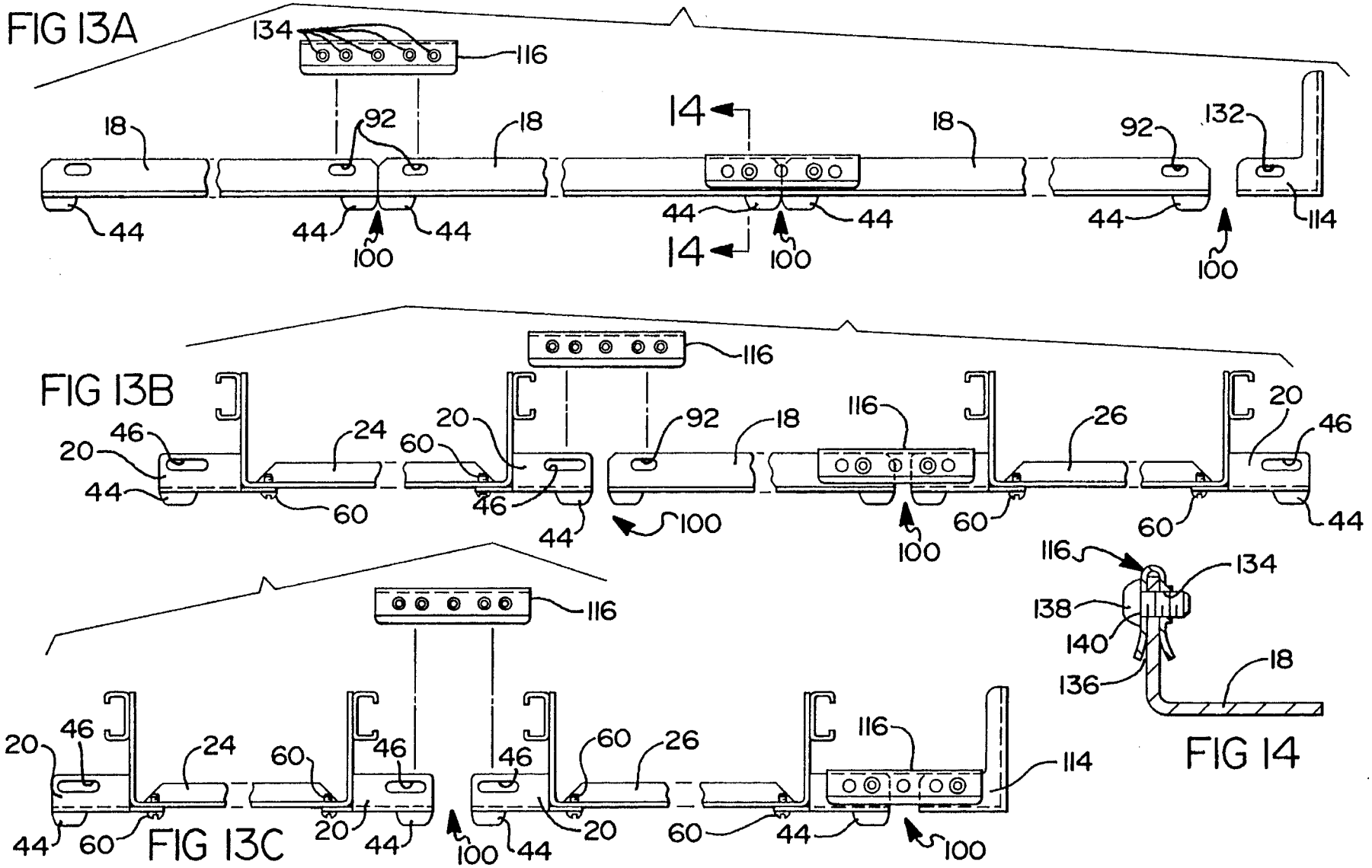
FIGS. 13A–13C are partial schematic front views similar to FIGS. 2A–2C illustrating the interconnection of seating units according to a second preferred embodiment of the invention.
FIG. 14 is a section view taken along line 14—14 of FIG. 13A.

As shown in FIG. 11, connecting link 116 is formed similar to connecting link 22, that is, it has a generally U shaped section with an opening 136 for snuggly fitting over connecting feet 20, frame rails 18 or angle brackets 114. In place of tabs 94, however, connecting link 116 is formed with a plurality of extruded, threaded apertures 134 for receiving threaded fasteners 138 and for securing connecting link 116 to connecting feet 20, angle brackets 114 or frame rails 18 (as shown in FIG. 14). The use of threaded fasteners 138 with connecting links 116 provides added clamping force of connecting link 116 to connecting feet 20, frame rails 18 or angle brackets 114 for enhancing the rigid interconnection of seating units and thus the rigid structure of the sofa or loveseat.

With reference to FIGS. 13A–13C, a number of alternative interconnected seating units is schematically illustrated. In FIG. 13A, three seating units adapted with frame rails 18 are shown interconnected and further interconnected to a seating unit adapted with angle bracket 114. FIG. 13B shows the interconnection of seating units adapted with connecting feet 20, frame rails 18 and angle brackets 114. And, similarly, FIG. 13C illustrates the interconnection of seating units adapted with connecting feet 20 and angle brackets 114.

As with the preceding embodiment, the seating units to be interconnected have frame rails 18, connecting feet 20 or angle brackets 114 secured thereto, as described and depending on the type of seating unit, and are aligned adjacent to each other. Connecting links 22 or 116 are then pressed over frame rails 18, connecting feet 20 or angle brackets 114, as described. If connecting links 22 are used, no further assembly is required. If connecting links 116 are used, after positioning connecting links 116 over frame rails 18, connecting feet 20 or angle brackets 116, threaded fasteners 138 are secured through apertures 140 and into threaded apertures 134 thus engaging elongated apertures 46, 92 or 132. As with the preceding embodiment, elongated apertures 46, 92 and 132 formed in connecting feet 20, frame rails 18 and angle brackets 114 provide for adjustment of the relative spacing between adjacent seating units for accommodating varying thicknesses of upholstery, padding, etc. and for preventing excessive gaps between adjacent seating units. In the preferred embodiment, elongate aperture 132 in angle bracket 114 is approximately ½ inch in length.

From the above it should be apparent that mounting apparatus 10 and 10' of the present invention serve to greatly simplify the ease with which modular sofas may be constructed, disassembled, moved, handled and adjusted. The mounting apparatus 10 and 10' further enable independent seating sections to be quickly and easily replaced with other types of seating sections as the owner desires.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A mounting apparatus for detachably securing together a plurality of independent seating units comprising:

interconnection means for providing a location for joining, said interconnection means including an elongated frame rail member removably attachable to an independent frame member associated with each of the independent seating units to be joined together; and joining means comprising an elongated connecting link having a U shaped cross-section for detachably securing together said interconnection means in end to end alignment.

2. The mounting apparatus of claim 1 further comprising means for adjusting side-by-side spacing of the independent seating units joined to form a sofa.

3. A mounting apparatus for detachably securing together a plurality of independent seating units comprising;

interconnection means for providing a location for joining, said interconnection means including an angle bracket removably attachable to an independent frame member associated with each of the independent seating units to be joined together; and joining means comprising an elongated connecting link having a U shaped cross-section for detachably securing together said interconnection means in end to end alignment.

4. The mounting apparatus of claim 3 wherein said interconnection means comprises a foot member secured to said angle bracket.

5. A mounting apparatus for detachably securing together a plurality of independent seating units comprising:

a frame associated with each of the independent seating units including a parallel front and rear portion and a side portion substantially perpendicular to said parallel front and rear portion;

interconnection means for providing a location for joining, said interconnection means being removably attachable to said side portion of the independent seating units to be joined together, said interconnection means being substantially parallel to said parallel front and rear portions of the independent seating units; and joining means comprising an elongated connecting link having a U Shaped cross-section for detachably securing together said interconnection means in end to end alignment.

6. The mounting apparatus of claim 5 wherein said interconnection means comprises elongated frame rail members having a generally L shaped cross-section and which are removably attachable to said side portion at said parallel front and rear portions of the independent seating units.

7. The mounting apparatus of claim 6 wherein said elongated connecting link includes a plurality of threaded apertures formed therein for receiving threaded fasteners which engage a plurality of apertures formed in said elongated frame members.

8. The mounting apparatus of claim 6 wherein said elongated connecting link includes at least two tabs formed therein for engaging a plurality of apertures formed in said elongated frame members.

9. The mounting apparatus of claim 8 wherein said apertures formed in said elongated frame rail member are slot shaped and said connecting link tabs have a width, and the length of said apertures is approximately twice as long as said width of said tabs whereby the independent seating units may be adjusted in side by side relation when joined to form a sofa.

10. The mounting apparatus of claim 9 wherein said slot shaped apertures are approximately ¾" in length, and said tabs are approximately ⅜" wide.

11. A mounting apparatus for detachably securing together a plurality of independent seating units comprising:

interconnection means for providing a location for joining, said interconnection means comprising a cantilevered member having a first end attached to an independent frame member associated with each of the independent seating units to be joined together and a joining location end opposite said first end; and joining means for detachably securing together said interconnection means whereby the independent seating units may be linked together, said joining means comprising an elongated connecting link having a U shaped cross-section and a bracket attachment end for releasably securing said interconnection means in end to end alignment.

12. The mounting apparatus of claim 4 wherein said cantilevered members comprise adjacent connecting feet members, said adjacent connecting feet members being removably attachable to the independent frame members.

13. The mounting apparatus of claim 12 wherein said elongated connecting link includes a plurality of threaded apertures formed therein for receiving threaded fasteners which engage a plurality of apertures formed in said adjacent connecting feet members.

14. The mounting apparatus of claim 12 wherein said elongated connecting link includes at least two tabs formed therein for engaging an aperture formed in each of said adjacent connecting feet members.

15. The mounting apparatus of claim 14 wherein said apertures formed in said adjacent connecting feet members are slot shaped and said connecting link tabs have a width, and the length of said apertures is approximately twice as long as said width of said tabs whereby the independent seating units may be adjusted in side-by-side relation when joined.

16. The mounting apparatus of claim 15 wherein said slot shaped apertures are approximately 1⅛" in length, and said tabs are approximately ⅜" wide.

17. A mounting apparatus for detachably securing together a plurality of independent seating units comprising:

interconnection means for providing a location for joining, said interconnection means attachable to a substantially vertical side wall portion associated with each of the independent seating units to be joined together opposite said location for joining; and joining means including an elongated connecting link having a U shaped cross-section for detachably securing together said interconnection means in end to end alignment.

18. The mounting apparatus of claim 17 wherein said interconnection means comprises adjacent angle bracket members, said adjacent angle bracket members being removably attachable to said side wall portions.

19. The mounting apparatus of claim 18 wherein said elongated connecting link includes a plurality of threaded apertures formed therein for receiving threaded fasteners which engage a plurality of apertures formed in said adjacent angle bracket members.

20. The mounting apparatus of claim 18 wherein said elongated connecting link includes at least two tabs formed therein for engaging an aperture formed in each of said adjacent angle bracket members.

21. The mounting apparatus of claim 20 wherein said apertures formed in said adjacent angle bracket members are slot shaped and said connecting link tabs have a width, and the length of said apertures is approximately twice as long as said width of said tabs whereby the independent seating units may be adjusted in side-by-side relation when joined.

22. The mounting apparatus of claim 21 wherein said slot shaped apertures are approximately ½" in length, and said tabs are approximately ⅜" wide.

* * * * *

UNITED STATES PATENT AND TRADEMARK OFFICE

CERTIFICATE OF CORRECTION

PATENT NO. : 5,520,437

DATED : May 28, 1996

INVENTOR(S) : Larry P. LaPointe, et al.

It is certified that error appears in the above-indentified patent and that said Letters Patent is hereby corrected as shown below:

On the Title Page under Attorney, Agent, or Firm

"Harness, Dickey & Pierce" should be -- Harness, Dickey & Pierce, P.L.C. --.

Column 4, line 15,
"08/040 004" should be -- 08/040,004 --.

Column 8, line 40, Claim 3,

"," should be -- : --.

Column 8, line 66, Claim 5,

"Shaped" should be -- shaped --.

UNITED STATES PATENT AND TRADEMARK OFFICE

CERTIFICATE OF CORRECTION

PATENT NO. : 5,520,437

DATED : May 28, 1996

INVENTOR(S) : Larry P. LaPointe, et al.

It is certified that error appears in the above-indentified patent and that said Letters Patent is hereby corrected as shown below:

Column 9, line 42, Claim 12,

"4" should be -- 11 --.

Column 9, line 45, Claim 12,

"members" should be -- member --.

Signed and Sealed this

Third Day of September, 1996

*Attest:*

*Attesting Officer*

BRUCE LEHMAN

*Commissioner of Patents and Trademarks*